US005568896A

United States Patent [19]

Adams et al.

[11] Patent Number: 5,568,896

[45] Date of Patent: Oct. 29, 1996

[54] METHODS FOR PREPARING PULPWOOD FOR DIGESTION

[75] Inventors: James E. Adams, Portland, Oreg.; John D. Lynn, Memphis, Tenn.; Ravindran Nadarajah, Vancouver, Wash.

[73] Assignee: Beloit Technologies, Inc., Wilmington, Del.

[21] Appl. No.: 200,089

[22] Filed: Feb. 22, 1994

[51] Int. Cl.[6] ..... B02C 4/02; B02C 23/08

[52] U.S. Cl. ..... 241/24.29; 241/28

[58] Field of Search ..... 241/24, 28, 34, 241/81, 82, 135, 79.1, 235, 24.29

[56] References Cited

U.S. PATENT DOCUMENTS

| | | | |
|---|---|---|---|
| 3,661,328 | 5/1972 | Leask | 241/18 |
| 4,050,980 | 9/1977 | Schmidt et al. | 162/24 |
| 4,332,353 | 6/1982 | Lario et al. | 241/14 |
| 4,953,795 | 9/1990 | Bielagus | 241/159 |
| 5,000,390 | 3/1991 | Marrs | 241/24 |
| 5,016,824 | 5/1991 | Pietinen et al. | 241/21 |
| 5,037,537 | 8/1991 | Bielagus | 209/382 |
| 5,110,453 | 5/1992 | Montgomery | 209/135 |
| 5,133,507 | 7/1992 | Sepling et al. | 241/78 |
| 5,137,621 | 8/1992 | Brown | 209/234 |
| 5,236,093 | 9/1993 | Marrs | 209/552 |

FOREIGN PATENT DOCUMENTS

| | | |
|---|---|---|
| 0417575 | 12/1968 | Australia . |
| 2444541 | 7/1980 | France . |
| 8402093 | 7/1984 | WIPO . |
| 8706506 | 11/1987 | WIPO . |

OTHER PUBLICATIONS

"DynaYield Chip Conditioner Cost effective overthick chip processing" Rader Companies, Portland, Oregon–Brochure (no date).

"Rader Cyclo–Screen Rader Cyclone that screens out chip fines dust and dirt" Rader Companies, Portland, Oregon–Brochure (no date).

Henry, John T. "Conditioning of Over–Thick Chips: An Alternative to Chip Slicing" TAPPI 1993, pp. 805–832.

"Rader Companies Rader Disc Screen" Rader Companies, Portland, Oregon–Brochure (no date).

"Rader Air Density Separator. The most efficient and versatile protection device for chip slicers and pulp mill equipment" Rader Companies, Portland, Oregon–Brochure (no date).

*Primary Examiner*—John M. Husar

*Attorney, Agent, or Firm*—Dirk J. Veneman; Raymond W. Campbell

[57] ABSTRACT

Methods for processing wood chips for digestion utilize a chip destructuring apparatus. The method includes an initial disc screen for removing the gross overthick and oversized chips which are discarded or are processed through a rechipper. After the initial disc screen, the entire stream of chips is processed to eliminate tramp metal. The entire chip stream is screened to remove fines. The stream of chips is fed to the chip destructuring apparatus from a surge bin with a star feeder. The star feeder is a metering device and is operated by a controller which monitors the level of chips in the surge bin. The controller uses the star feeder to feed a steady supply of chips to the chip destructuring apparatus which allows the destructuring apparatus to be configured for a maximum feed rate.

19 Claims, 5 Drawing Sheets

METHODS FOR PREPARING PULPWOOD FOR DIGESTION

FIELD OF THE INVENTION

The present invention relates to methods of treating and separating wood chips in preparation for subsequent pulping operations. More particularly, the present invention relates to methods for treating wood chips employing chip destructuring by passage through a nip or nips formed between two, three or four opposed rolls.

BACKGROUND OF THE INVENTION

In the production of paper from wood fibers, the wood fibers must be freed from the raw wood. In one widely used method, this is accomplished by cooking the wood fibers in a solution until the material holding the fibers together, lignin, is dissolved. In order to achieve rapid and uniform digestion by the cooking liquor, the wood, after it has been debarked, is passed through a chipper which reduces the raw wood to chips. The raw chips from the chipper may contain many overthick and oversized and grossly overthick and oversized wood chips. The raw chips also contain fines, dust-like material having little useful fiber; and pins, material slightly larger than fines, having some useful fiber which can be tolerated in the pulping process at an acceptable proportion.

Existing processes for preparing pulpwood for digestion after it has been reduced to chips by a chipper have normally involved multiple screening steps to separate out the acceptable chips from the oversized and grossly oversized chips. The overthick and oversized and grossly overthick and oversized chips are normally then reprocessed through a rechipper, slicer or chip destructuring device to convert them into acceptable chips.

A recently developed device for processing wood chips includes closely operating rolls which are provided for supplying compressive forces to chips passing therebetween, wherein at least one roll has an aggressively contoured surface for causing chips to crack in the thickness dimension of the chip as compressive force is applied to the chip.

As disclosed in U.S. Pat. No. 4,953,795 to Bielagus, such a chip destructuring device may be used with oversized chips separated at a previous screening step, or the entire chip flow in a pulping operation can be processed through such an apparatus. Bielagus further discloses that in other applications it may be desirable to separate only the undersized chips from the total chip stream and then process both oversized and acceptable size chips through the apparatus. Bielagus points out that a high volume of chips can be passed through the chip destructuring apparatus, making it possible to process the entire chip flow in the pulp mill, potentially eliminating the need for screening out oversized chips. Bielagus teaches that if acceptable and oversized chips can all be passed through the apparatus, it is unnecessary to separate the over-large chips for separate treatment.

One known method of preparing wood chips for digestion in the pulping process employs a double gyratory or rotary wave-type screen having a first set of holes approximately seven-eights to one-and-a-quarter inch in diameter, and a second screen sized to remove fines with openings of approximately an eighth of an inch. The first screen removes a large portion of the over-thick and oversize chips and also a large portion of the acceptable chips. The reject flow from the first screen is all run through the chip destructuring device, the output of which is combined with that which passed the first screen to form a combined stream which is suitable for being converted to pulp at the same time.

Methods are needed for employing chip destructuring devices which will prepare wood chips for pulping with reduced cost, space and maintenance requirements.

SUMMARY OF THE INVENTION

The methods for preparing pulpwood for digestion of this invention utilize a chip destructuring apparatus to process the entire flow of chips in a pulping operation. The method for preparing wood pulp for digestion includes an initial disc screen for removing the gross overthick and oversized chips which are discarded or are processed through a rechipper. After the initial disc screen, and with or without the addition of the rechipped gross overs, the entire stream of chips is processed to eliminate tramp metal. In the methods of this invention, the entire chip stream is screened to remove fines, either before or after the entire stream of chips has been processed by the chip destructuring apparatus. The stream of chips is fed to the chip destructuring apparatus from a surge bin with a star feeder. The star feeder is a metering device and is operated by a controller which monitors the level of chips in the surge bin. The controller uses the star feeder to feed a steady supply of chips to the chip destructuring apparatus, which allows the destructuring apparatus to be configured for a maximum feed rate. The controller stops the flow of chips if there are insufficient chips in the bin to supply the flow rate needed for the high flow rate configured destructuring apparatus.

It is an object of the present invention to prepare pulpwood for digestion with reduced overall cost.

It is another object of the present invention to prepare pulpwood for digestion with reduced space requirements.

It is a further object of the present invention to provide a method for preparing pulpwood for digestion with lower maintenance costs and higher screening efficiency.

It is a still further object of the present invention to provide a homogeneous mixture of wood chips to the wood chip digester.

It is yet another object of the present invention to provide a method of preparing pulpwood for digestion which utilizes less machinery.

It is a still further object of the present invention to provide a method for preparing pulpwood for digestion which requires less horse power for a given tonnage of wood processed.

Further objects, features, and advantages of the invention will be apparent from the following detailed description when taken in conjunction with the accompanying drawings.

DESCRIPTION OF THE PREFERRED EMBODIMENTS

Figure 1:
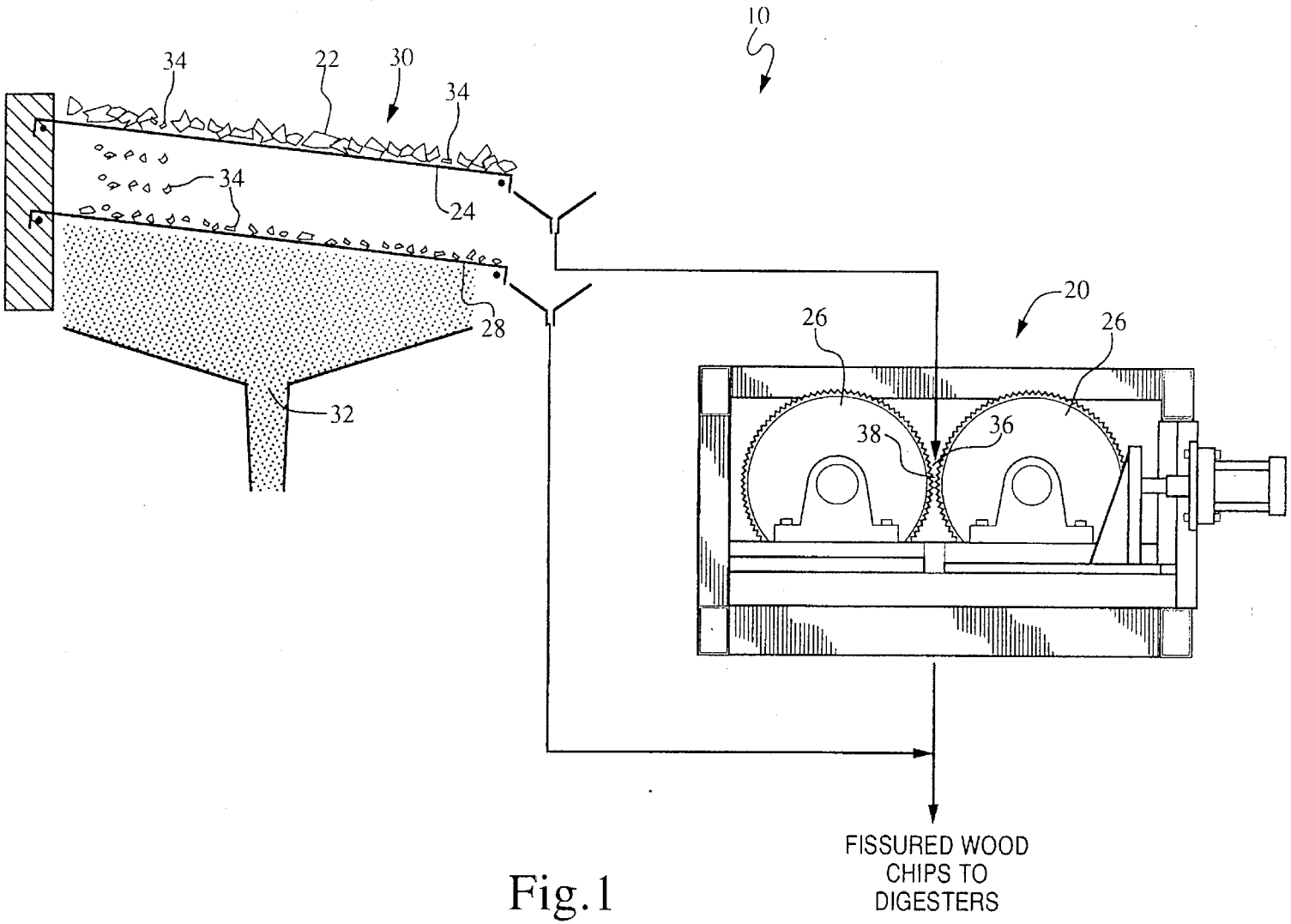
Fig. 1 (PRIOR ART)
FIG. 1 is a somewhat schematic view of a prior art process for preparing pulpwood for digestion.

Referring to FIGS. 1–5, wherein like numbers refer to similar parts, a prior art method 10 of utilizing a chip destructuring device 20 in processing a stream of chips 12 for digestion, is shown in FIG. 1. The process 10 employs either a gyratory, rotary or wave-type screen 30 to remove the oversized chips 22. In doing so, a large portion of the acceptable chips 34 are also removed. This reject flow goes directly to the chip destructuring device 20 for cracking between the rolls 26. Protection equipment which would be required if a slicer or rechipper were used to process the over-thick chips is not required because the chip destructuring device is less sensitive to damage from rocks and tramp metal; however, such protection equipment may be used.

The process 10 employs two screen decks 24, 28; the upper deck 24 having either round or square holes about seven-eighths to one-and-a-quarter inch in size. The second deck 28, which is located below the first screen deck 24 in the gyratory screen 30, removes fines 32 from acceptable size chips 34. Acceptable size chips 34 are added to the chips 22 passing through the chip destructuring device and sent to the digester for processing.

The process 10 of FIG. 1 illustrates one way in which a chip destructuring device may be utilized for preparing a stream of wood chips for pulping. The process 10 takes advantage of the fact that the chip destructuring device 20 produces little fines. Thus, the fines may be removed before processing by the chip destructuring device 20, with no fines separation after the destructuring device. Further, the chip destructuring device 20 has a gap 36 at the nip 38 between the rolls 26 which may be adjusted so that chips 34 of acceptable size are affected little by passage through the nip 38. On the other hand, the over-sized chips 22 are fractured along the grain by the aggressively contoured surface of the rolls 26. This is disclosed more fully in U.S. Pat. No. 4,953,795 to Bielagus, which is incorporated herein by reference.

Although the known system 10 in FIG. 1 has achieved some success in utilizing a chip destructuring device 20, improved methods capable of handling larger flows with less wear on the rolls are desirable.

Figure 2:
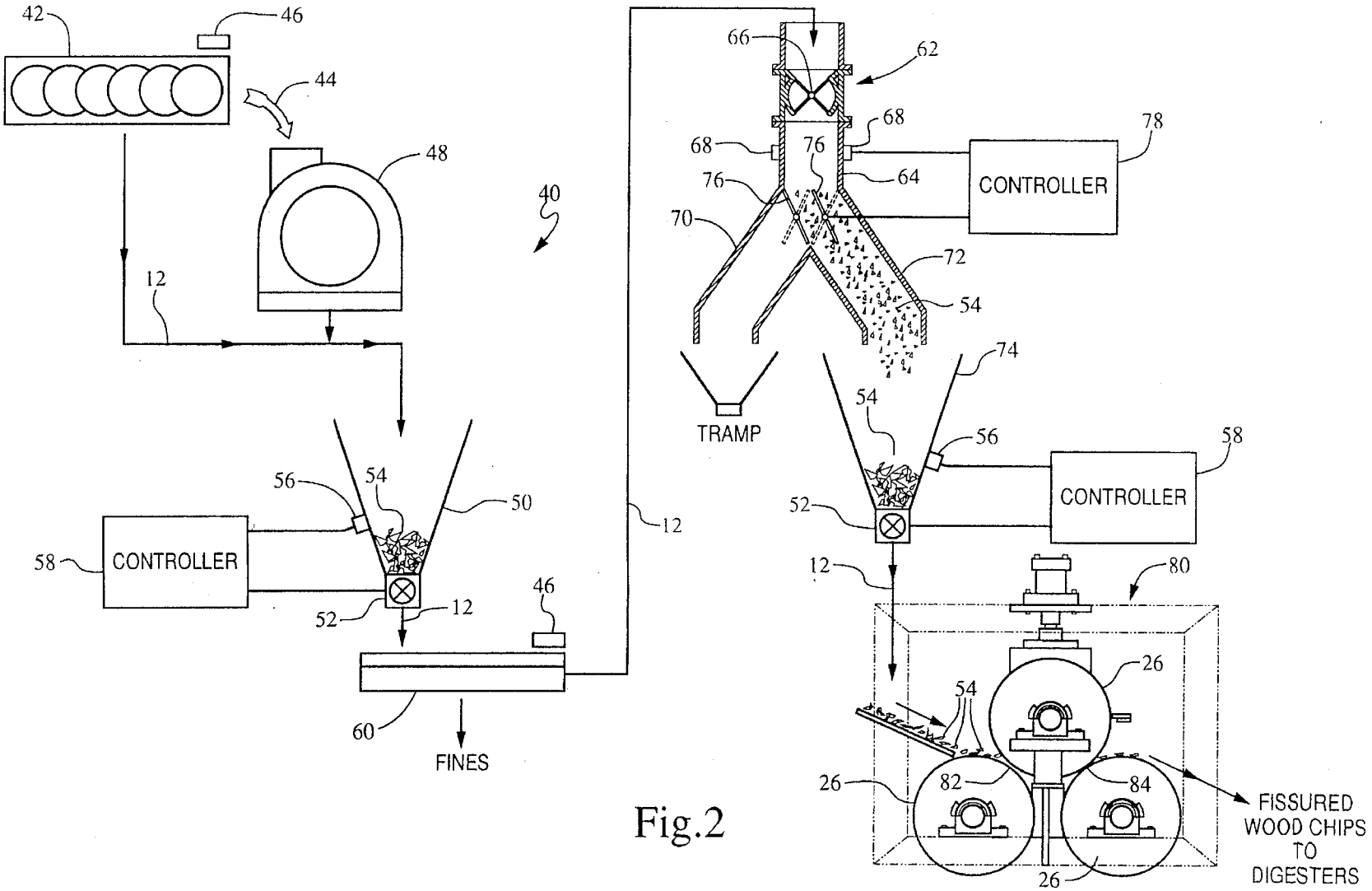
FIG. 2 is a somewhat schematic view of the method of this invention for preparing pulpwood for digestion.

A chip conditioning process 40 of the present invention is shown in FIG. 2. The process employs a scalping screen 42 which is diagramatically illustrated as a disc screen, but which could be a bar screen, or other type of screen. The scalping screen 42 separates the gross overthick and oversize chips 44 from the chip stream 12. A magnet 46 is disposed over the scalping screen 42 to remove tramp ferrous metals. The gross over chips 44 are fed to a rechipper 48 where the gross overthick and oversize chips 44 are rechipped to reduce them to acceptable size. The chips are then delivered to a first surge bin 50. The surge bin has a star feeder 52. The star feeder 52 is a metering device similar to a revolving door. As long as the surge bin 50 contains an adequate volume of wood chips 54, the vertical rotation of the star feeder 52 will precisely control the flow of chips. Further, because the star feeder 52 extends axially, it can deliver a metered flow which is not only constant in time but also even along the axis of the star feeder. Thus, a star feeder 52 can supply an even flow through a processing device which is a screen or chip destructuring device of a given length.

In order for the star feeder 52 to function properly, the surge bin must contain a minimum level of chips. To assure that the chips 54 are supplied at a constant rate from the star feeder 52, a surge bin level sensor 56 is employed. The output of the sensor 56 is read by a controller 58, which controls the flow of chips 54 from the star feeder 52. The controller is normally set such that a constant stream 12 of chips is supplied. If insufficient chips in the surge bin 50 are sensed, the star feeder 52 is stopped. Thus, chip processing equipment can be optimized for a stream of chips 12 which is very nearly constant.

The output of the star feeder 52, as shown in FIG. 2, flows to a fines screen 60. The screen 60 removes fines which contain no useful fibers and thus decrease the strength and quality of the paper produced. The definition of fines generally varies from paper plant to plant, but is normally defined as that which will pass a screen with a circular hole of three to five millimeters, or one-eighth to three-sixteenths of an inch. The fines screen 60 may be any of a number of types known to those skilled in the art. For example, the screen shown in U.S. Pat. No. 5,037,537 to Bielagus, may be used as a fines screen. A magnet 46 is positioned over the fines screen, again to remove any tramp ferrous metals.

After the fines screen 60, the stream of chips 12 enters a safety device. The safety device 62 includes a conduit 64 for accommodating the stream of wood chips 12. A rotary valve 66 is positioned in the conduit 64 to control the flow of chips 12 through the conduit 64. A sensor 68 is positioned downstream of the rotary valve and senses the presence of metal in the stream 12. Downstream of the sensor is a first shunt conduit 70 leading to a chip dumping bin and a second shunt conduit 72 leading to a second surge bin 74. A pair of dampers 76 controls whether chips flow into the first conduit 70 or into the second conduit 72. The flow is normally directed into the second conduit and hence into the second surge bin 74.

The metal detecting safety device 62 utilizes a controller 78 which, upon receiving a signal from the sensor 68 indicating the presence of metal, simultaneously operates the dampers 76 and the valve 66 to divert the flow. When the sensor 68 through the controller 78 detects metal, the dampers 76 are moved so that material flows into the first conduit 70, and the valves 66 are closed for a predetermined interval. Thus, the safety device 62 effectively eliminates all tramp metals from the stream of chips 12. A suitable safety device is disclosed by U.S. Pat. No. 5,263,651 to Nadarajah.

The stream of chips flows from the safety device 62 into a second surge bin 74. The surge bin 74 has a star feeder 52. As long as the surge bin 74 contains an adequate volume of wood chips 54, the vertical rotation of the star feeder 52 will precisely control the flow of chips.

In order for the star feeder 52 to function properly, the surge bin 74 must contain a minimum level of chips 54. As in the first surge bin, the second surge bin 74 has a level sensor 56 connected to a controller 58, which controls the flow of chips 54 from the star feeder 52. The controller is normally set such that a constant stream 12 of chips is supplied. If insufficient chips in the second surge bin 74 are sensed, the star feeder 52 is stopped. Thus, chip processing equipment can be optimized for a stream of chips 12 which is very nearly constant.

The stream of chips metered from the second surge bin 74 flows into a multi nip chip conditioner 80. The multi nip conditioner has rolls 26 which form a first nip 82 and a second nip 84. Because of the metered flow of chips from the star feeder 52 of the second surge bin 74, the spacing of the first nip 82 may be configured to take advantage of the high volume flow of chips so that the destructuring or cracking of the chips 54 takes place as the chips are compressed against each other as they pass through the nip.

It is evident that the spacing of the rolls 26 to form the first nip 82 which will function well with the large flow of chips 54, where several chips 54 span the gap forming the nip 82, will not function with a lower flow of chips where only a single chip passes the nip 82 at one time. Thus, the importance of the surge bin 74 and the star-feeder-metered flow of chips 54 which allows the chip destructuring apparatus 80 to be configured for a high volume flow. The multi nip chip conditioner will also permit gentler destructuring or cracking of the chips. A signle nip chip conditioner may be used here instead of a multi nip chip conditioner. A single nip chip conditioner is a low cost alternative to the multi nip chip conditioner.

Figure 3:
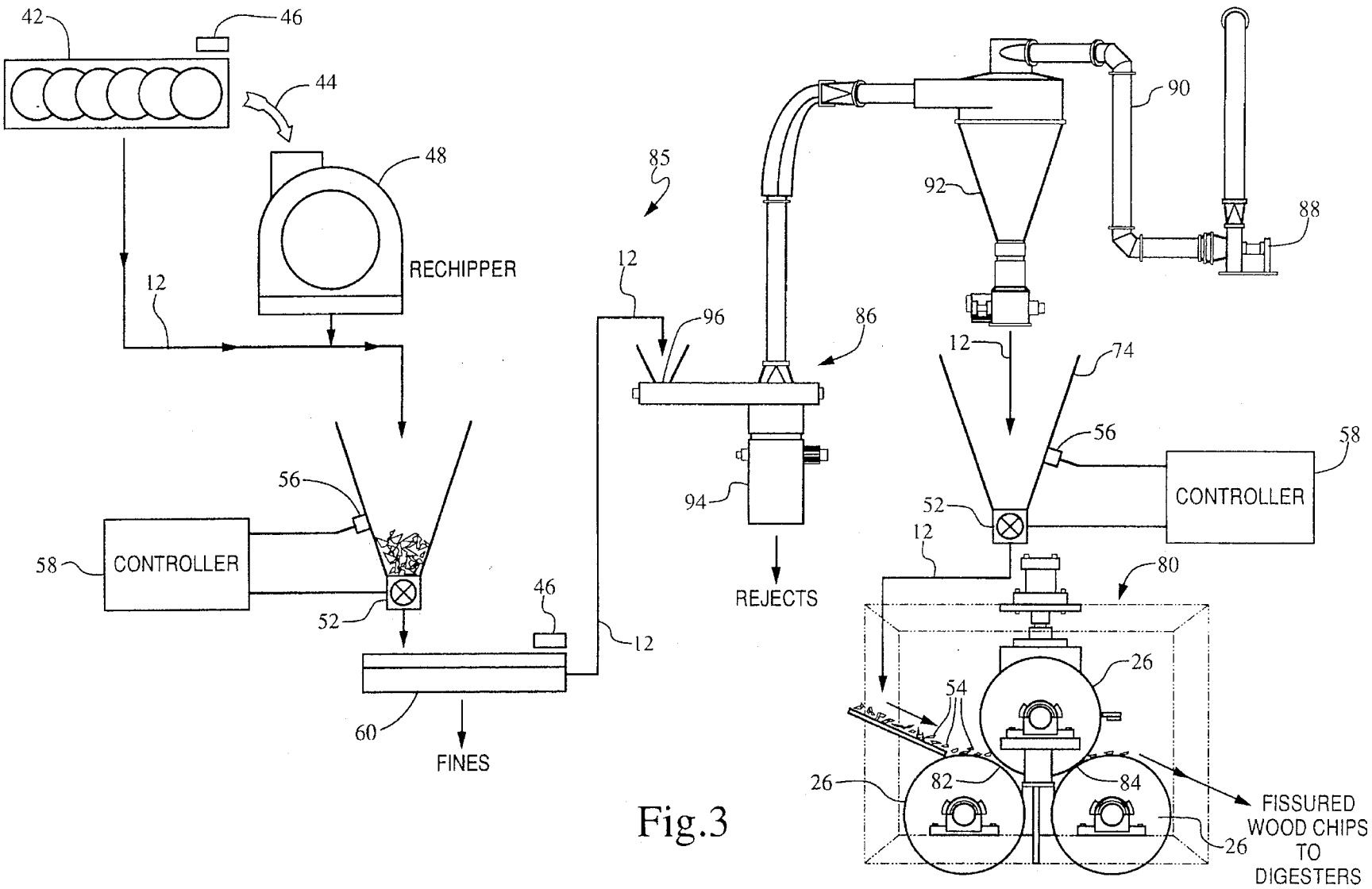
FIG. 3 is an alternative embodiment of the method of this invention for preparing pulpwood for digestion.

An alternative chip conditioning method 85 is shown in FIG. 3. The chip conditioning process 85 is similar to the chip conditioning process shown in FIG. 2, except the safety device 62 is replaced by an air-density separator assembly 86. The air-density separator (ADS) assembly 86 employs a fan 88 which draws air through a conduit 90, thence through a cyclone 92, which in turn draws air from a separation chamber 94. The ADS assembly 86 is fed by a metering screw conveyor infeed 96. The air density separator 86 allows for a vacuum of air to be pulled across an adjustable separation chamber 94. Rocks, knots and tramp metal drop out of the flow of chips 12 at the separation chamber 94. All acceptable chips are conveyed to the cyclone 92.

The air density separation system 86 allows greater freedom in the placement of the process equipment, resulting in lower capital cost, and eases service and maintenance. By effectively removing tramp and rocks, the air density separator system 86 reduces the maintenance required of the chip conditioner 80. Further, the removal of knots which are often resinous and dark in color improves the quality of the pulp resulting from the stream of chips 12.

Figure 4:
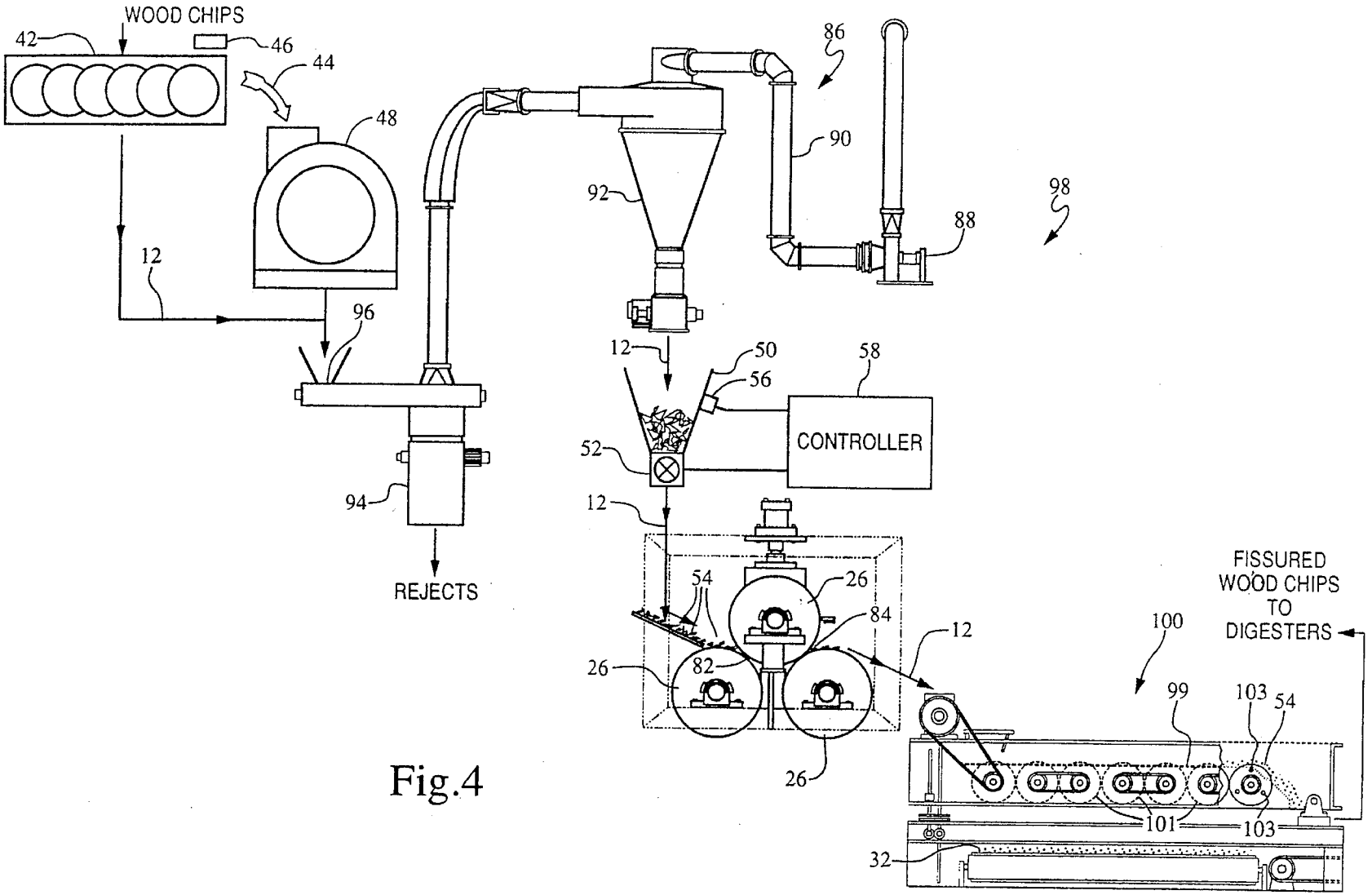
FIG. 4 is a somewhat schematic view of another alternative method for preparing pulpwood for digestion.

Another alternative embodiment method 98 is shown in FIG. 4, which is an alternative version of the method 85 of FIG. 3. In the method shown in FIG. 4, the fines are removed after the destructuring process by the destructuring apparatus 80. A wood particle screen 100 has a screen bed 99 consisting of flexible foraminous material having holes sized to allow fines to pass through. The screen bed 99 is flexibly mounted for receiving a flow of wood chips 54 and fines thereon. Beater rolls 101 are disposed beneath the screen bed 99, each of which includes a plurality of spaced beater bars 103 so positioned as to contact the bottom of the screen bed as a bar 103 rotates to the uppermost position of the roll 101.

The placement of the fines screen 100 after the chip destructuring device 80 advantageously serves to remove residual bark. Bark is normally undesirable in paper making. Bark is low in fiber and imparts undesirable, dark matter in the finished paper. Before pulpwood is processed into chips, the bark is normally removed from the pulpwood. However, the debarking process is less than one-hundred percent effective. The result of the inefficiencies of the debarking process is that a certain percentage of the chips 54 will have residual bark attached thereto. Bark is more brittle than wood, and the destructuring process which compresses and flexes the chips as they pass through the opposed rollers 26 breaks the bark, reducing it to fines, which allows its removal on the screen 100 after the destructuring process.

Figure 5:
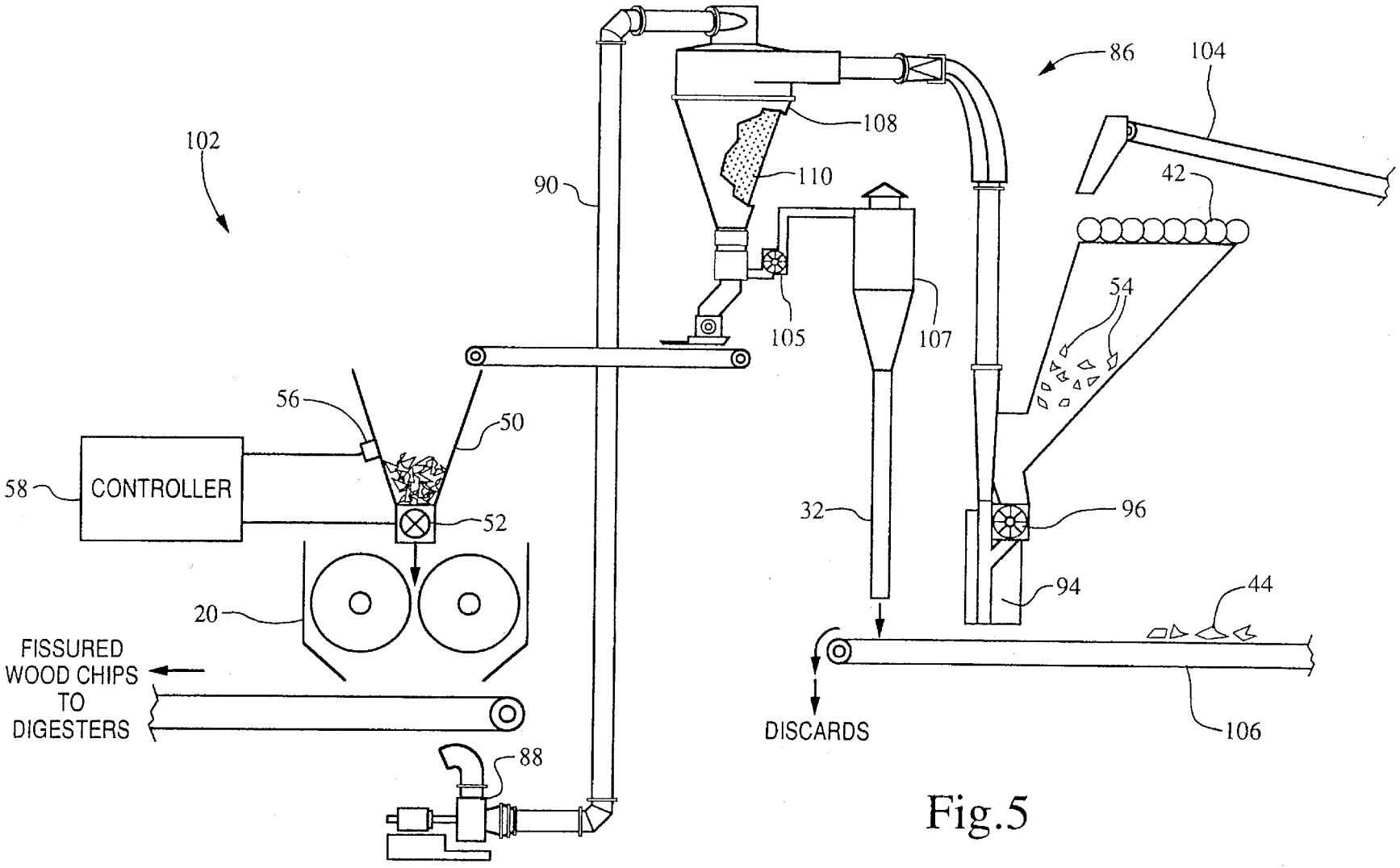
FIG. 5 is a further alternative method for preparing pulpwood for digestion.

Yet another method 102 for preparing chips of this invention is shown in FIG. 5. This alternative method employs a conveyor 104 which delivers chips to a scalping screen 42, which separates gross over-sized chips 44, which are discarded onto a discard conveyor 106. The stream of acceptable size chips 54 enters an air density separator 86 through a metering infeed 96 and passes into a separation chamber 94, where metal tramp and rocks are separated out and allowed to fall onto the discard conveyor 106. A cyclone 108 is connected to the separation chamber 94. Air is supplied to the cyclone 108 through the conduit 90 by a fan 88. The cyclone 108 incorporates an inner cone 110 which forms a screen made of perforated stainless steel plate. As the air and material pass over the inner surface of the cone, reject particles pass through the perforations while accept material discharges out of the bottom of the cyclone. The fines 32 are drawn off by a fan 105 and into a second cyclone 107 where the fines are separated from the air stream and deposited on the discard conveyor 106. In this way, the air density separator performs the functions of removing tramp metal, rocks and knots, as well as fines.

Acceptable size wood chips are advanced into a surge bin 50, similar to those described above and is fed to a destructuring device 20 from which the fissured wood chips are conveyed to the digesters.

It should be understood that although a safety device is shown as used in the method of FIG. 2, an air density separator as used in the method 85 of FIG. 3, or an air knife apparatus as disclosed in U.S. Pat. No. 5,110,453 to Montgomery, which is incorporated herein by reference, could be used for separating tramp metal and rocks from the desired chip flow. It should also be understood that, although an air density separator is a more efficient and effective method for removing unacceptable material from a stream of chips being processed for digestion, it is more costly than an air knife system, which in turn is more costly than the safety device illustrated in FIG. 2. A suitable safety device is disclosed by U.S. Pat. No. 5,263,651 to Nadarajah.

It should also be understood that wherein a conventional chip processing stream uses multiple disc screens which have large area extent and require conveyors and elevators between them, the processes disclosed herein accomplish considerable savings in space and equipment, thereby reducing the cost of preparing chips for digestion.

It should also be understood that whereas three rolls are shown producing two progressive nips in a chip destructuring device, a chip destructuring device 20 with two rolls and a single nip could be used, or two sets of two rolls stacked one above the other could be used. Further, three or more nips could be used to progressively condition the chips.

It should also be understood that the invention is not confined to the particular construction and arrangement of parts herein illustrated and described, but embraces such modified forms thereof as come within the scope of the following claims.

We claim:

1. A method for preparing a stream of pulpwood chips for subsequent delignification of the wood fibers, said stream including acceptable size chips overthick and oversize chips and gross overthick and oversize chips, the method employing a chip destructuring apparatus of the type having two opposed rolls forming a nip therebetween, wherein the method comprises the steps of:

screening said stream of wood chips to obtain a first fraction of chips containing substantially all of said gross overthick and oversize chips, and a second fraction containing substantially only acceptable size and overthick and oversize chips;

accumulating said second fraction of wood chips in a surge bin;

sensing the level of chips in the bin;

controlling a means for chip metering so that a constant flow of chips is metered when the sensed level of chips within the bin exceeds a selected level, and no chips are allowed to flow if the sensed level of chips within the bin is below the selected level, which would not support a given flow;

passing said second fraction of chips from the bin through a chip destructuring apparatus, thus allowing the destructuring apparatus to be configured for a uniform high level of chip processing; and destructuring a substantial portion of chips, said destructuring being done without substantial size reduction.

2. The method of claim 1 including the steps of adjusting opposing rolls of the destructuring apparatus to a gap not less than the thickness of a predetermined acceptable size chip and, passing the chips between the rolls so that destructuring takes place with multiple chips between the rolls.

3. The method of claim 1 further comprising the steps of subjecting chips in said first fraction to a size reduction process, and combining the size-reduced chips with said second fraction of wood chips in said surge bin.

4. The method of claim 1 wherein the accumulation of wood chips in a surge bin takes place immediately before chip destructuring.

5. The method of claim 1 further comprising the step of separating fines from the stream of wood chips before they are accumulated in the surge bin.

6. The method of claim 1 further comprising the step of screening to remove fines after the stream of chips have been destructured.

7. The method of claim 1 further comprising the step of removing tramp metal from the stream of wood chips before they are accumulated in the surge bin.

8. The method of claim 1 further comprising the step of passing the second fraction of wood chips through an air density separator for removing tramp metal, rocks and knots before the step of accumulating the stream of wood chips in a surge bin.

9. The method of claim 1 further comprising the step of separating tramp metal, rocks and knots from the second fraction of wood chips in a means for separating, before accumulating said second fraction in the surge bin.

10. The apparatus of claim 1 further comprising the steps of:

scalping the gross over chips and discarding the same, separating tramp metal, rocks and knots with an air density separator; and removing fines from the stream of chips in a cyclonic screen, all these steps performed before accumulating the second fraction in a surge bin.

11. A process for preparing pulpwood for subsequent delignification in a digester, for individualizing wood fibers contained in said pulpwood, the process comprising the steps of:

screening a stream of wood chips from a chipper to remove from said stream substantially only gross oversized chips;

separating and discarding wood fines contained in the stream of wood chips;

separating at least the tramp metal from the stream of wood chips; and passing all chips remaining in the stream to be digested through a chip conditioner having opposed rolls thereby compressing and destructuring the oversized chips between discrete projections on the surface of the rolls said compressing and destructuring being caused to occur without substantial size reduction of the chips.

12. The method of claim 11 wherein the chip destructuring apparatus is configured with a gap between rolls at least exceeding the width of the typical chip so that destructuring takes place with multiple chips between the rolls.

13. The apparatus of claim 11 further comprising the step of accumulating a stream of wood chips in a surge bin having a metering function before passing all chips in the stream to be digested through the chip conditioner.

14. The method of claim 13 wherein the accumulation of wood chips in a surge bin takes place immediately before chip destructuring.

15. The method of claim 13 further comprising the step of removing tramp metal from the stream of wood chips before the chips are accumulated in the surge bin.

16. The method of claim 11 wherein the step of separating fines from the stream of wood chips takes places before passing all chips in the stream to be digested through the chip conditioner.

17. The method of claim 11 wherein the step of separating fines from the stream of wood chips takes places after the stream of chips has been destructured in the chip conditioner.

18. The method of claim 11 wherein the step of separating at least the tramp metal form the stream of wood chips is accomplished by passing the stream of wood chips through an air density separator for removing tramp metal, rocks and knots before the step of passing all chips in the stream to be processed through the chip conditioner.

19. The method of claim 11 wherein the step of separating and discarding wood fines contained in the stream of wood chips is accomplished by a cyclonic screen.

* * * * *